US006181280B1

(12) United States Patent
Kadambi et al.

(10) Patent No.: US 6,181,280 B1
(45) Date of Patent: Jan. 30, 2001

(54) SINGLE SUBSTRATE WIDE BANDWIDTH MICROSTRIP ANTENNA

(75) Inventors: Govind R. Kadambi; Thomas F. Masek, both of Lincoln, NE (US)

(73) Assignee: Centurion Intl., Inc., Lincoln, NE (US)

( * ) Notice: Under 35 U.S.C. 154(b), the term of this patent shall be extended for 0 days.

(21) Appl. No.: 09/362,385

(22) Filed: Jul. 28, 1999

(51) Int. Cl.[7] ..... H01Q 1/38
(52) U.S. Cl. ..... 343/700 MS; 343/770
(58) Field of Search ..... 343/700 MS, 767, 343/770, 846, 848

(56) References Cited

U.S. PATENT DOCUMENTS 4,379,296 * 4/1983 Farrar et al. ..... 343/700 MS
4,701,763 * 10/1987 Yamamoto et al. ..... 343/700 MS
5,420,596 * 5/1995 Burrell et al. ..... 343/700 MS

OTHER PUBLICATIONS

S. Maci, et al. "Dual–band slot–loaded patch antenna", IEE Proc.–Microw. Antennas Propag., vol. 142, No. 3, Jun. 1995, pp. 225–232.

S. Maci, et al. "Single–Layer Dual Frequency Patch Antenna", Electronics Letters Aug. 5th, 1993, vol. 29, No. 16, p. 1441 to p. 1443.

Bao F. Wang, et al. "Microstrip Antennas for Dual–Frequency Operation", IEEE Transactions on Antennas and Propagation, vol. AP–32, No. 9, Sep. 1984, pp. 938–943.

* cited by examiner

*Primary Examiner*—Tan Ho
(74) *Attorney, Agent, or Firm*—Zarley, McKee, Thomte, Voorhees & Sease; Dennis L. Thomte

(57) ABSTRACT

A microstrip antenna comprising a substrate, a radiating element constructed on the top surface of the substrate, a ground plane on the bottom surface of the substrate, a through hole at a position corresponding to the radiating element of the substrate, and a power feeding conductor at a position corresponding to the radiating element on the substrate.

2 Claims, 21 Drawing Sheets

SINGLE SUBSTRATE WIDE BANDWIDTH MICROSTRIP ANTENNA

BACKGROUND OF THE INVENTION

1. Field of the Invention

The present invention relates to microstrip antennas and, in particular, to a method of enhancing the bandwidth of a microstrip antenna without increasing the size or weight of the antenna.

2. Description of the Related Art

Microstrip antennas have many interesting properties such as low profile and lightweight. However, the inherent narrow bandwidth of a microstrip antenna is one of its serious disadvantages. The conventional microstrip antenna typically exhibits a bandwidth of only 1–2% of the resonant frequency. The narrow bandwidth of the microstrip antenna is often inadequate to meet the requirements for practical applications. The development of techniques for the enhancement of the bandwidth of microstrip antenna has been a topic of special emphasis for several years.

A conventional microstrip antenna is shown in FIGS. 17A and 17B. The microstrip antenna 170 illustrated in FIGS. 17A and 17B consists of a dielectric substrate 101, a radiating element 102 constructed on the top surface of the substrate 101 and a ground plane 103 constructed on the bottom surface of the substrate 101. A power feed hole 104 is provided at a point corresponding to the radiating element 102 on the substrate 101. A connector 105, used for feeding radio frequency (RF) power to the radiating element 102, is inserted through the feed hole 104 from the bottom surface of the substrate 101. The connector 105 is electrically connected to the radiating element 102 with solder 106*a* and is fixed to the ground plane 103 by solder 106*b*.

The techniques currently available for enhancing the bandwidth of microstrip antennas (MSA) include use of a thicker substrate, multi-layer stacked microstrip antennas, electromagnetically coupled (EMC) microstrip antennas, microstrip antennas with parasitic elements, aperture coupled microstrip antennas, and use of external matching circuits. As will be clear from the explanations to be provided, some of the above techniques result in an increase in size and weight of the microstrip antenna while some others suffer from the lack in the structural simplicity usually associated with conventional microstrip antennas.

The prior art structural configurations of microstrip antenna for the improvement of bandwidth using the above mentioned techniques are described below. The elements of new microstrip antennas which are similar to that of the conventional microstrip antenna 170 will have same reference numbers as in FIGS. 17A and 17B and additional reference explanations will be omitted.

The prior art microstrip antenna 120 with thick substrate material shown in FIGS. 12A and 12B has the undesirable characteristics of increased height and weight of the antenna. The thick substrate of the microstrip antenna shown in FIGS. 12A and 12B increases the dielectric loss and also increases the cost of the antenna. The thick substrate of the antenna of FIGS. 12A and 12B also causes the generation of surface waves and hence degrades the radiation pattern, which is not desirable.

The prior art microstrip antenna 130 with parasitic elements illustrated in FIG. 13 has two additional parasitic elements 107 adjacent to the radiating element 102. A narrow gap separates these parasitic elements 107 from the main radiating element 102. The microstrip antenna 130 has the disadvantages of increased length and weight.

FIG. 14 illustrates the configuration of a prior art electromagnetically coupled microstrip antenna 140. Antenna 140 has two substrates 101 placed one above the other. The bottom surface of the top substrate 101 does not have conductive film. There is a radiating element 102 on the top surface of the upper substrate 101 and a narrow microstrip line 108 on the top surface of the lower substrate 101 acts as a feed for the radiating element 102. The microstrip antenna 140 has the disadvantages of increased height, increased weight and higher cost.

A prior art microstrip antenna 150 with multi-layer stacked elements is illustrated in FIG. 15. Antenna 150 has two radiating microstrip elements 102, one on the top surface of upper substrate 101 and the other on the top surface of the middle substrate 101. The radiating elements 102 are stacked one above the other. A narrow microstrip line 108 is positioned on the top surface of bottom substrate 101. Microstrip line 108 serves as a common feed for the two radiating elements 102. As in microstrip antenna 140, there is no conductive film on the bottom surfaces of the upper and middle substrates 101. The disadvantages of microstrip antenna 150 are increased height, weight, complexity of design, and higher cost.

A prior art aperture coupled microstrip antenna 160 is shown in FIG. 16 and comprises a radiating element 102 on the top surface of upper substrate 101 and a conductive ground plane 103 with an opening or aperture 109. A narrow microstrip feed line 108 positioned on the top surface of bottom substrate 101 serves as a feed to the aperture 109. Power is coupled to the radiating element 102 through the aperture 109. The disadvantages of microstrip antenna 160 are structural complexity, design complexity, increased height, increased weight, and higher cost.

The prior art microstrip antenna with external matching circuit involving inductors and capacitors does not increase the height and or linear dimensions of the antenna. The inductors and capacitors are used near the feed point of the microstrip antenna and provide a better impedance match, hence an improvement in bandwidth results. The disadvantage is that increased bandwidth is at the expense of an undesirable loss in gain of the antenna. Although the matching circuit components are part of the device to which the microstrip antenna is attached and technically are not part of the antenna, they do add to the total cost of the device.

In the past, shorting pins or slots have been used in microstrip antennas to reduce the resonant frequency or to achieve a dual frequency mode of operation. In the prior art, slots or shorting pins have been used separately to achieve dual frequency performance of the antenna. See, for example, S. C. Pan and K. L. Wong "Design of Dual Frequency Microstrip Antennas using shorting pin loading", IEEE-APS Symposium, Atlanta, June 1998, pp. 312–315; K. L. Wong and W. S. Chen, "Compact microstrip antenna with dual-frequency operation", Electronics Letters, Apr. 10th 1997, Vol. 33, No. 8, pp. 646–647; S. Maci, Biffi Gentili, P. Piazzesi and C. Salvador, "Dual band slot-loaded patch antenna", IEE Proc.-Microw. Antennas Propag., Vol. 142, No. 3, June 1995, pp. 225–232; and S. Maci, G. Biffi Gentili and G. Avitabile, "Single-Layer Dual Frequency Patch Antenna", Electronics Letters, Aug. 5th 1993, Vol. 29, No. 16, pp. 1441–1443, hereinafter referred to as Pan et al., Wong et al., Maci et al., and Maci et al. (II), respectively.

B. F. Wang and Y. T. Lo, "Microstrip Antennas for Dual-Frequency Operation", IEEE Transactions on Antennas and Propagation, Vol. AP-32, No. 9, September 1984, pp. 938–943, describes the dual frequency operation of a microstrip antenna using a combination of slots and shorting pins. In the above-cited references, the obtained bandwidths centered around the dual resonant frequencies have been relatively narrow (1–2% of resonant frequencies). There is also a practical lower limit for ratio of ($f_u/f_L$) ($f_u$ and $f_L$ being the upper and lower resonant frequencies, respectively). As a consequence of the lower ratio of ($f_u/f_L$), the resonant bands centered around the dual resonant frequencies are rather widely separated. Therefore, combining the two narrow resonant bands to improve the overall bandwidth is very difficult using the previously used configurations that have been illustrated in the above references.

To circumvent the existing disadvantages of the available microstrip antenna bandwidth enhancing techniques, it is the objective of the present invention to design a single substrate microstrip antenna possessing structural simplicity, wider bandwidth, lightweight, compact size, ease of fabrication, and cost effective to manufacture.

SUMMARY OF THE INVENTION

A compact, wide bandwidth and lightweight microstrip antenna has been designed in order to satisfy the above objectives. The present invention emphasizes the improvement of the bandwidth using only a single substrate or layer. The microstrip antenna of this invention is characterized by: a substrate; a radiating element on the top surface of the substrate; a ground plane on the bottom surface of the substrate; a power feeding conductor placed in a position corresponding to the radiating element on the substrate; three conductive shorting posts or pins arranged along the center line of the radiating element adjacent to the power feeding conductor; two adjacent slots in the radiating element located on the same half of the radiating element with respect to the center line.

The microstrip antenna of this invention depicted in FIGS. 1 and 2 illustrates that the power feeding conductor, and conductive shorting posts, are positioned along the centerline referenced as 2—2 in FIG. 1. Unlike the dual frequency mode antennas of Maci et al. and Maci et al. (II), the two slots are on the same half of the radiating element with respect to center line 2—2. By using both slots and shorting pins as configured in the foregoing antenna, the two resonant frequencies have been adjusted to have a very close separation resulting in a low frequency ratio of ($f_{3U}/f_{3L}$) as illustrated in FIG. 3B. In FIG. 3B, it appears that the dual bandwidths centered around the two resonant frequencies ($f_{3L}$,$f_{3U}$) have been combined and adjusted to achieve one wider band. In reality, there are two separate frequency bands but the VSWR in the region between the two frequency bands does not rise above 2:1. This results in the two adjacent narrow frequency bands effectively functioning as one single wide band. The contributing factors for the wide bandwidth characteristics are; the position of the feed pin, the size of the feed pin, the sizes of the slots, the positions of the slots, the sizes of the shorting pins, positions of the shorting pins, as well as the number of shorting pins. Through a selective combination of the above parameters, a good impedance matching condition for broad band performance has been achieved. The bandwidth of the microstrip antenna for VSWR<2 is 93 MHz (3.8%) as compared to the 1–2% bandwidth typical of the conventional style microstrip antenna 170 of FIG. 7.

In the above described microstrip antenna 10, a radiating element can be constructed in a square or rectangular shape. The resonant frequency is determined by a combination of the substrate dielectric constant and the dimensions of the radiating element. In the foregoing microstrip antenna 10, the slots have been designed to introduce a reactive load to the radiating element thereby producing dual resonant frequencies. The reactive loading also enables the antenna to resonate at a lower resonance frequency (FIG. 9B) than is typical of a conventional microstrip antenna (FIG. 5B) without increasing the overall physical dimensions the antenna. The positions and sizes of the slots determine the resonant frequencies and have been adjusted to align the resonant bands close to desirable band (FIG. 9B).

In the microstrip antenna of this invention, the positions of the conductive shorting posts or pins have been varied for further tuning of the resonant bands that have been produced by the slots in the radiating element. The shorting pins are also positioned away from the center of the antenna causing an upward shift of the lower resonant frequency. The resulting frequency ratio of ($f_{3U}/f_{3L}$) is 1.023 as shown in FIG. 3B. The diameter of the conductive shorting posts (pins) and the distance of separation between the posts may also be adjusted to vary the resultant reactance offered by the shorting posts. The combination of the reactance of the shorting pins and the position of the feed pin can be adjusted to achieve a good impedance match (low VSWR) in the desirable resonant bands of the microstrip antenna.

BRIEF DESCRIPTION OF THE DRAWINGS

FIG. 3 illustrates the performance characteristics of the microstrip antenna according to the embodiment of this invention;

FIG. 5A is a Smith Chart and FIG. 5B is a frequency response graph that depicts the characteristics of the VSWR;

FIG. 7A is a Smith Chart and FIG. 7B is an illustration of the frequency response characteristics of the VSWR;

FIG. 9A is a Smith Chart and FIG. 9B illustrates the frequency response characteristics of the VSWR;

FIG. 11A is a Smith Chart and FIG. 11B illustrates the frequency response characteristics of the VSWR;

FIG. 12A shows the plan view of the microstrip antenna and FIG. 12B is a sectional view taken along the line 12B—12B of FIG. 12A;

DESCRIPTION OF THE PREFERRED EMBODIMENTS

Figure 1:
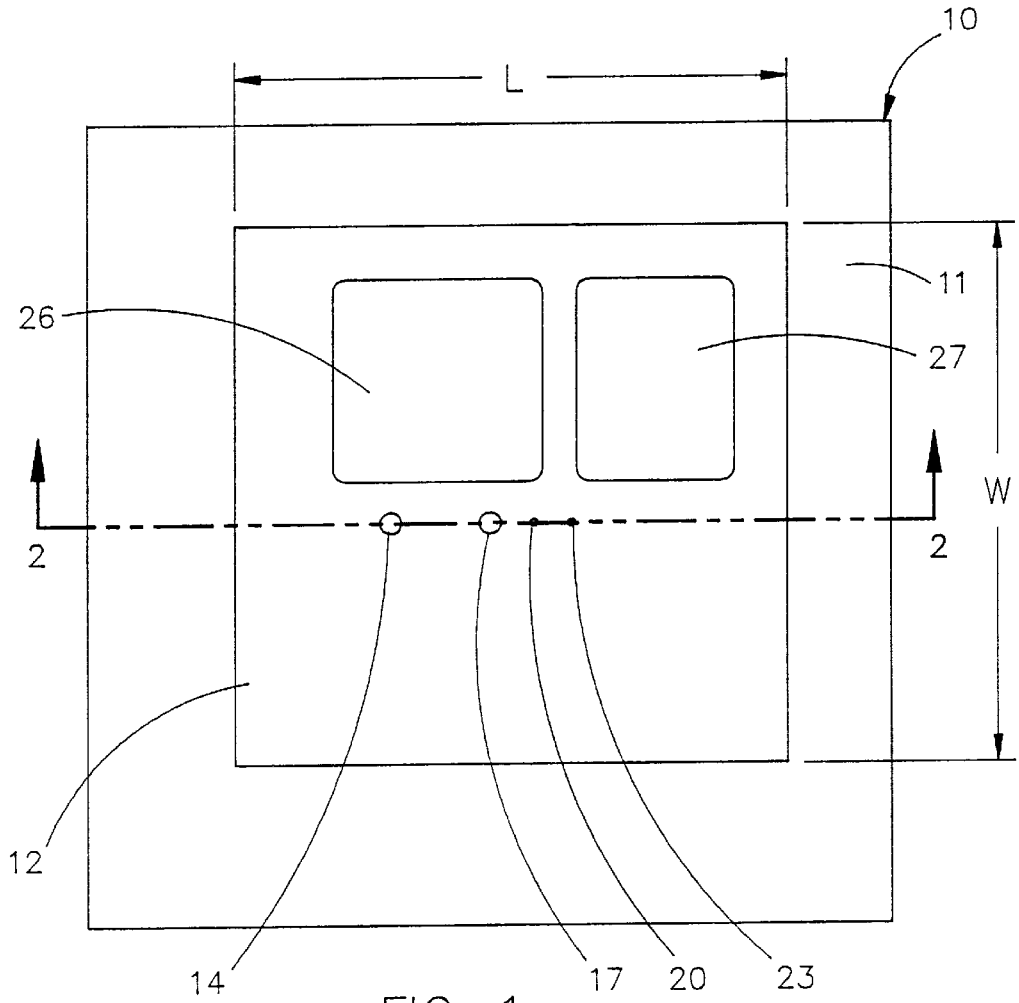
FIG. 1 is an illustration of the design configuration of a microstrip antenna according to one embodiment of the present invention.

Preferred embodiments of the present invention are now explained while referring to the drawings.

Figure 2:
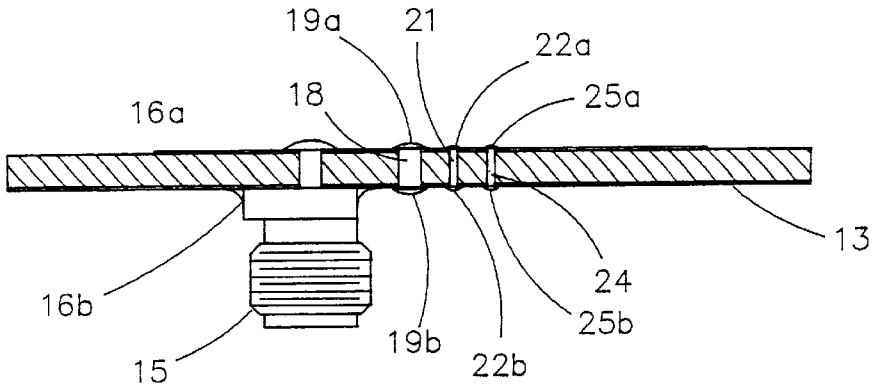
FIG. 2 is a sectional view taken along the line 2—2 of FIG. 1.

Referring to FIGS. 1 and 2, a radiating element 12 of the microstrip antenna 10 is constructed on the top surface of the substrate 11. A ground plane 13 is constructed on the bottom surface of the substrate 11. A power feed hole 14 is provided at the position corresponding with the radiating element 12 of the substrate 11.

The connector or feed pin 15, serving as a coaxial line for supplying Radio frequency (RF) power to the radiating element 12, is inserted through the feed hole 14. The connector 15 is electrically connected to the radiating element 12 at 16*a* with solder. The body of connector 15 is connected to the ground plane 13 with solder at 16*b*.

A through hole 17 is positioned corresponding to the radiating element 12 on the substrate 11. A conductive post or pin 18, which functions as a short circuit between the radiating element 12 and the ground plane 13, is inserted through the hole 17. The conductive post 18 is connected to the radiating element 12 at 19*a* with solder. The conductive post 18 is also connected to the ground plane 13 at 19*b* with solder.

A through hole 20 is positioned corresponding to the radiating element 12 on the substrate 11. A conductive post or pin 21, which functions as a short circuit between the radiating element 12 and the ground plane 13, is inserted through the hole 20. The conductive post 21 is connected to the radiating element 12 at 22*a* with solder. The conductive post 21 is also connected to the ground plane 13 at 22*b* with solder.

A through hole 23 is positioned corresponding to the radiating element 12 on the substrate 11. A conductive post or pin 24, which functions as a short circuit between the radiating element 12 and the ground plane 13, is inserted through the hole 23. The conductive post 24 is connected to the radiating element 12 at 25*a* with solder. The conductive post 24 is also connected to the ground plane 13 at 25*b* with solder.

The slots 26 and 27, which are designed to offer reactive loading to the radiating element 12, are positioned to be adjacent to each other and are on the same half of the radiating element 12 with respect to the center line 2—2 of FIG. 1.

The radiating element 12 generally is in a square or rectangular shape. The slots 26 and 27 can also be either in a square or rectangular shape. The radiating element 12 and the slots 26 and 27 are constructed by removing the conductive film deposited on the top surface of the substrate 11. The conductive posts 18, 21 and 24 are circular in shape and can be of different diameters.

The microstrip antenna 10 configured as specified above, functions as an antenna in which the radiating element 12 corresponds to a single frequency band only. The resonant frequency and the bandwidth of the microstrip antenna, without the slots 26 and 27 and shorting pins 21 and 24, are determined by the dimensions of the radiating element 12, the height of the substrate 11 and the dielectric constant of the substrate 11. A combination of the radiating element 12, the slots 26 and 27 and the shorting pins 21 and 24 results in dual frequencies of a lower value than the resonant frequency of the radiating element 12 alone. This is due to the reactive loading effects of the slots 26 and 27 and the shorting pins 21 and 24 on the radiating element 12.

Figure 3A:
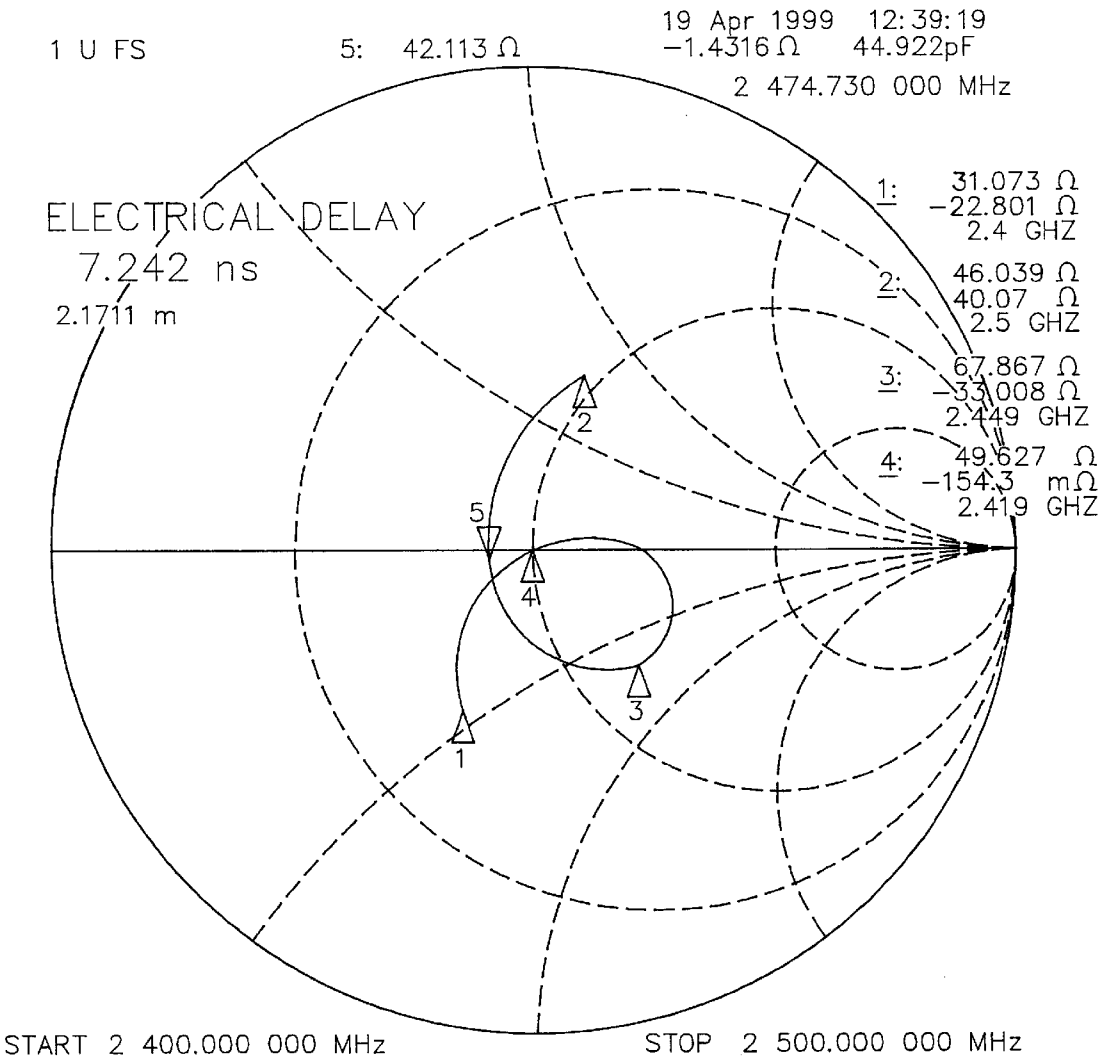
FIG. 3A is a Smith Chart depicting the impedance variation of the antenna of FIG. 1.
Figure 3B:
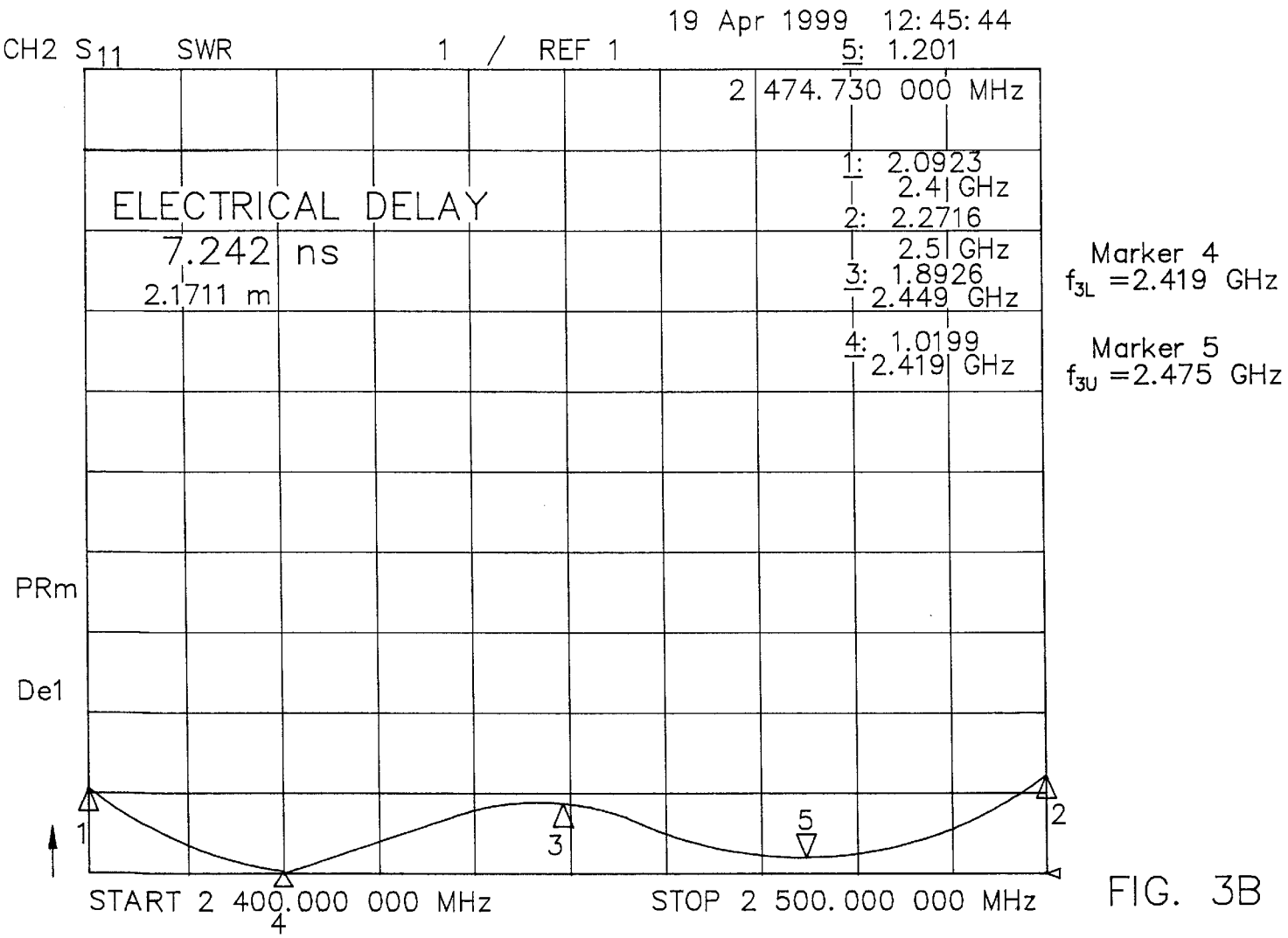
FIG. 3B is a frequency response graph that depicts the characteristics of the VSWR of the antenna of FIG. 1.

The results of the tests conducted on the embodiment of this invention referred to in FIGS. 1 and 2 are as follows: FIG. 3A is a Smith chart showing the impedance characteristics of the embodiment 10 of this invention and FIG. 3B illustrates the VSWR frequency response of the embodiment 10 of this invention. FIG. 3B illustrates the dual resonance characteristics of microstrip antenna 10 in which the two resonant frequencies are at $f_{3L}$=2.419 GHz and $f_{3U}$=2.475 GHz . The two resonant bands are within the ISM band of 2.4–2.5 GHz. FIG. 3B also illustrates that the frequency ratio of ($f_{3U}/f_{3L}$) is 1.023. The bandwidth (for VSWR<2) centered around $f_{3L}$ is 1.94% and the corresponding bandwidth centered around $f_{3U}$ is 1.86%. The two bands centered around $f_{3L}$ and $f_{3U}$ are combined to produce a relatively wider bandwidth of 93 MHz (3.8%). The substrate 11 of the antenna tested has a dielectric constant of 3.38.

Figure 4A:
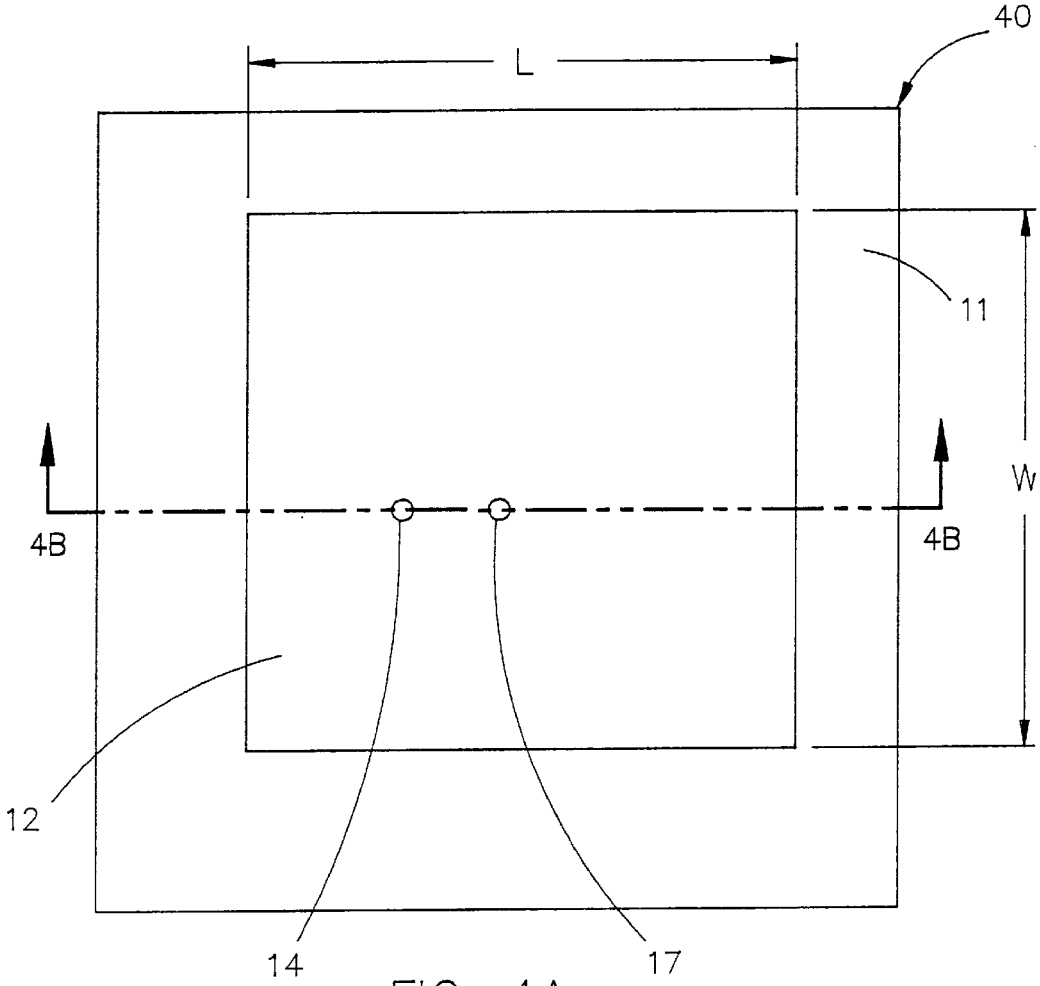
FIG. 4A illustrates the design configuration of a microstrip antenna, but does not show a shorting post.
Figure 4B:
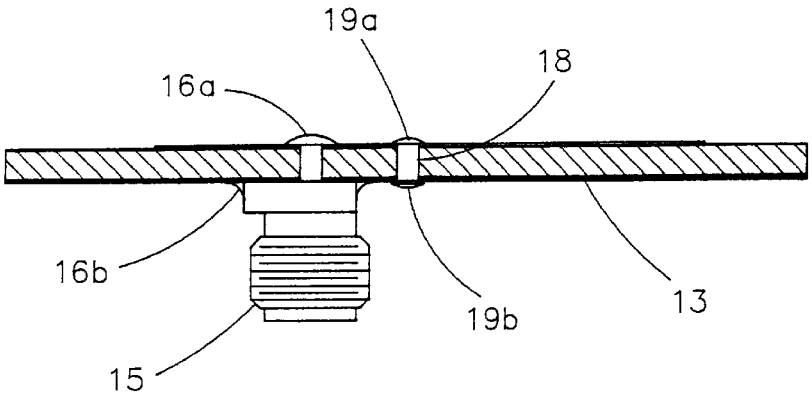
FIG. 4B is a sectional view taken along the line 4B—4B of FIG. 4A illustrating shorting post.
Figure 5A:
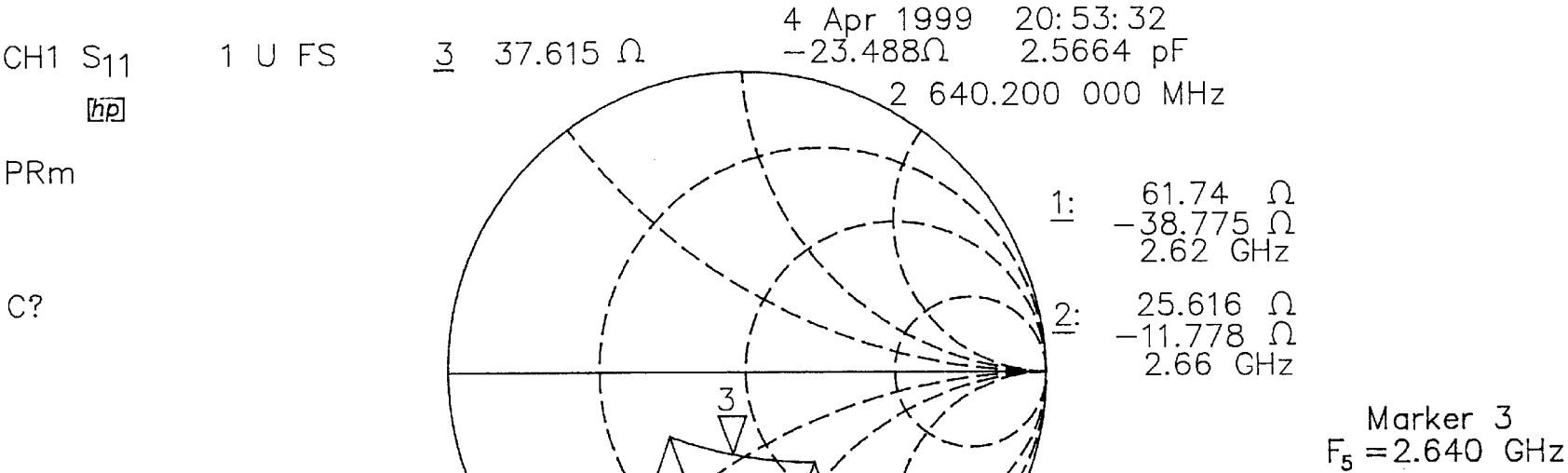
FIGS. 5A and 5B illustrate the performance characteristics of the microstrip antenna of FIG. 4.
Figure 5B:
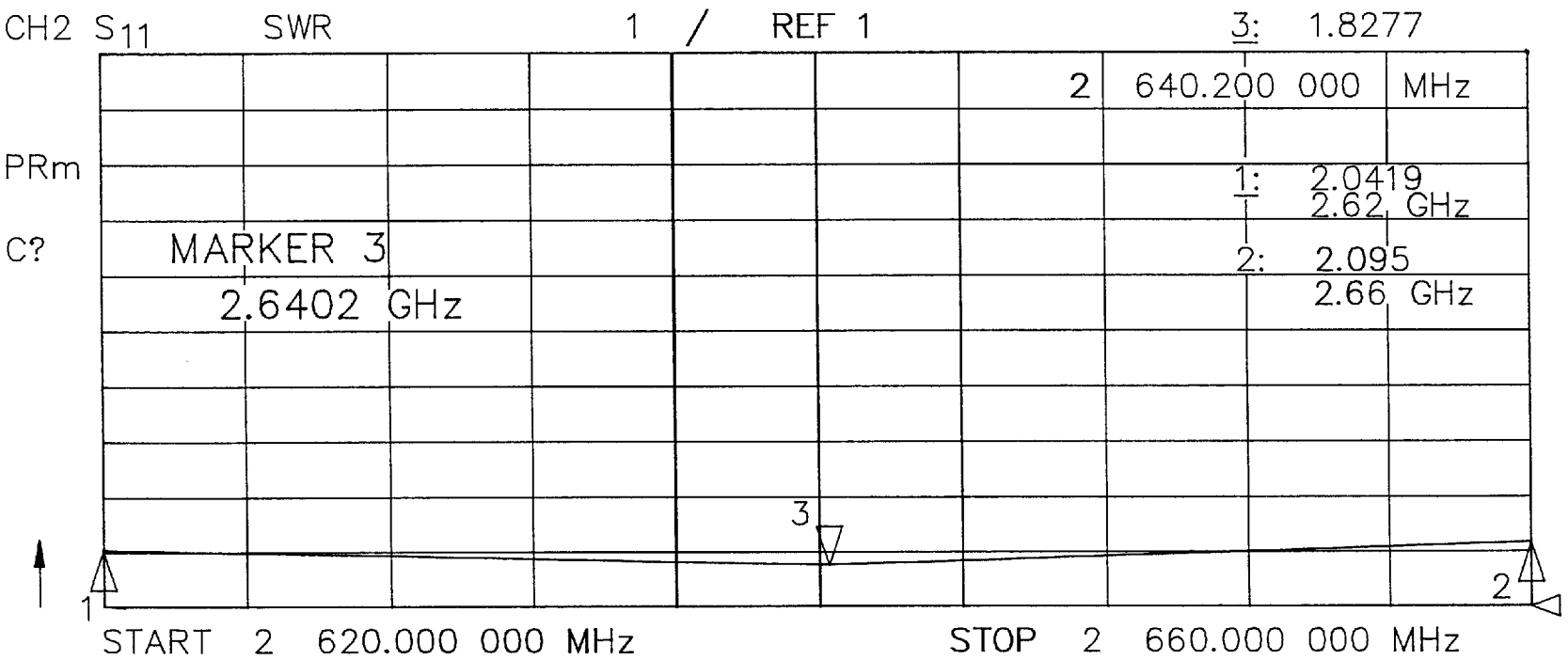

To arrive at the configuration of this invention, a conventional style microstrip antenna has undergone an evolution of changes. An explanation highlighting the results of the measurement at various intermediate steps is given to illustrate the role of each individual element of the antenna 10. Microstrip antenna 40 shown in FIG. 4, differs from microstrip antenna 10 in that the antenna 40 does not have slots and has only one conductive shorting post 18. The conductive shorting posts or pins 18 in both the antenna 10 and the antenna 40 are at the center of the respective antennas. The conductive shorting posts 18 at the center of antenna 10 and antenna 40 have no effect on the impedance or resonant frequencies of antennas. The conductive shorting posts 18 allow low frequency grounding of the antennas. The elements of microstrip antenna 40 (FIG. 4) having the same component configuration as that of antenna 10 (FIGS. 1 and 2) are designated by same reference numerals to keep the illustrations clear and consistent. For component descriptions refer to, FIGS. 1 and 2. The length [L] and widths [W] of the radiating elements 12 of antennas 10 and 40 are identical. Likewise, the dielectric constants of the substrates 11 of antenna 10 and antenna 40 are identical. The connectors 15 shown in FIGS. 2 and 4 are at identical positions. The test results of microstrip antenna 40 (FIG. 4) are shown in FIGS. 5A and 5B. The microstrip antenna 40 has a narrow bandwidth of 1.52% centered around the resonant frequency $f_5$=2.640 GHz as illustrated in FIG. 5B. The resonant frequency $f_5$=2.640 GHz of antenna 40 is higher than $f_{3L}$ and $f_{3U}$ (FIG. 3B) of microstrip antenna 10 of this invention. The test data shown in FIG. 5B is a result representative of a conventional type of microstrip antenna.

Figure 6A:
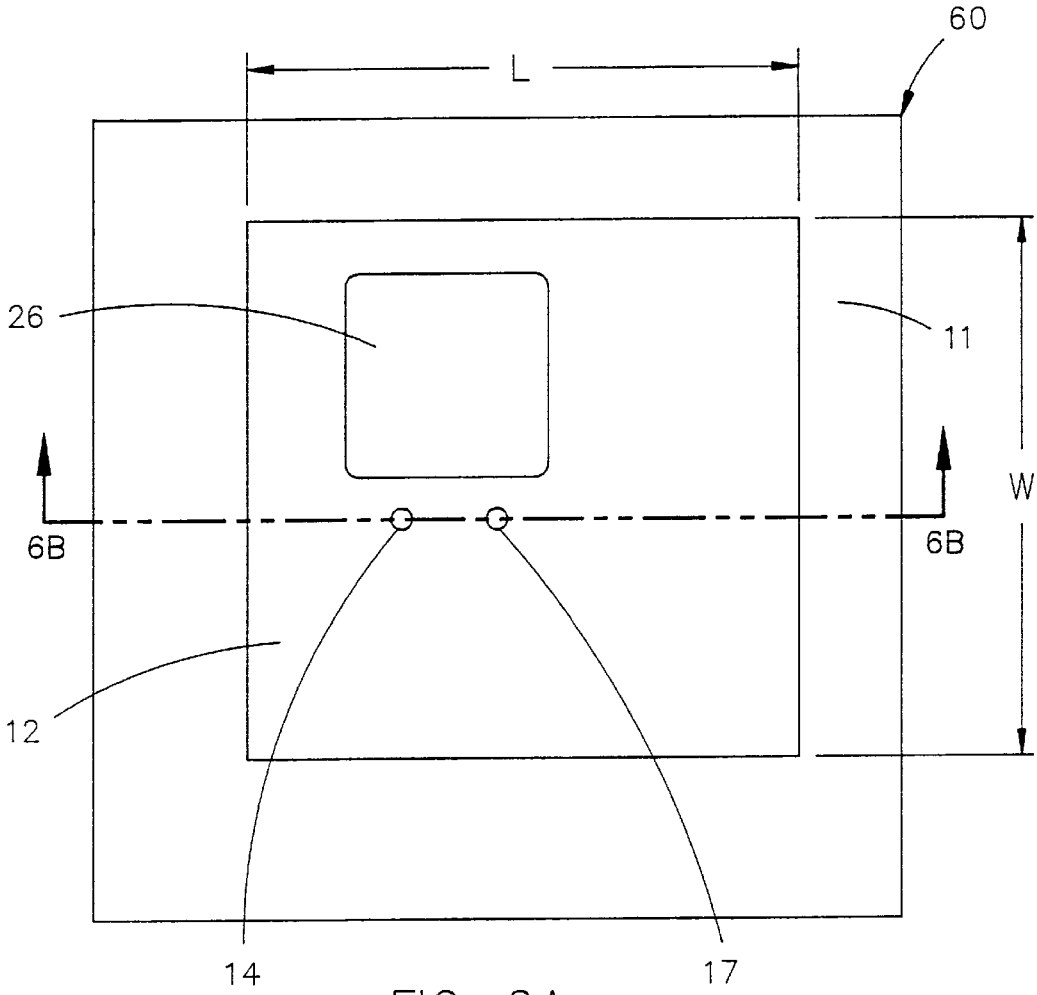
FIG. 6A illustrates the design configuration of a further embodiment of the microstrip antenna.
Figure 6B:
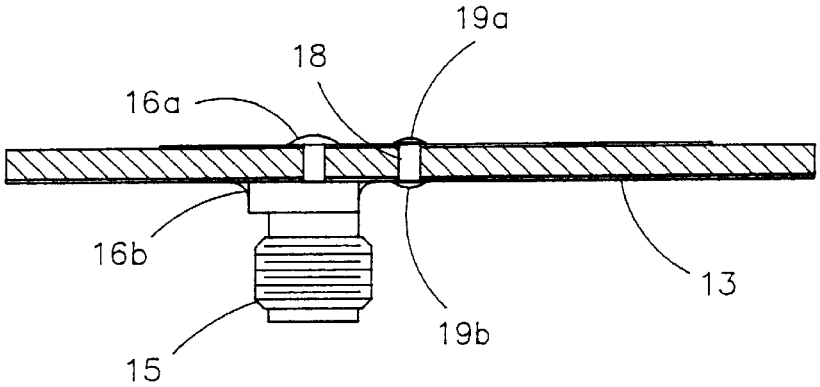
FIG. 6B is a sectional view taken along the line 6B—6B of FIG. 6A which shows a shorting post which is not shown in FIG. 6A.
Figure 7A:
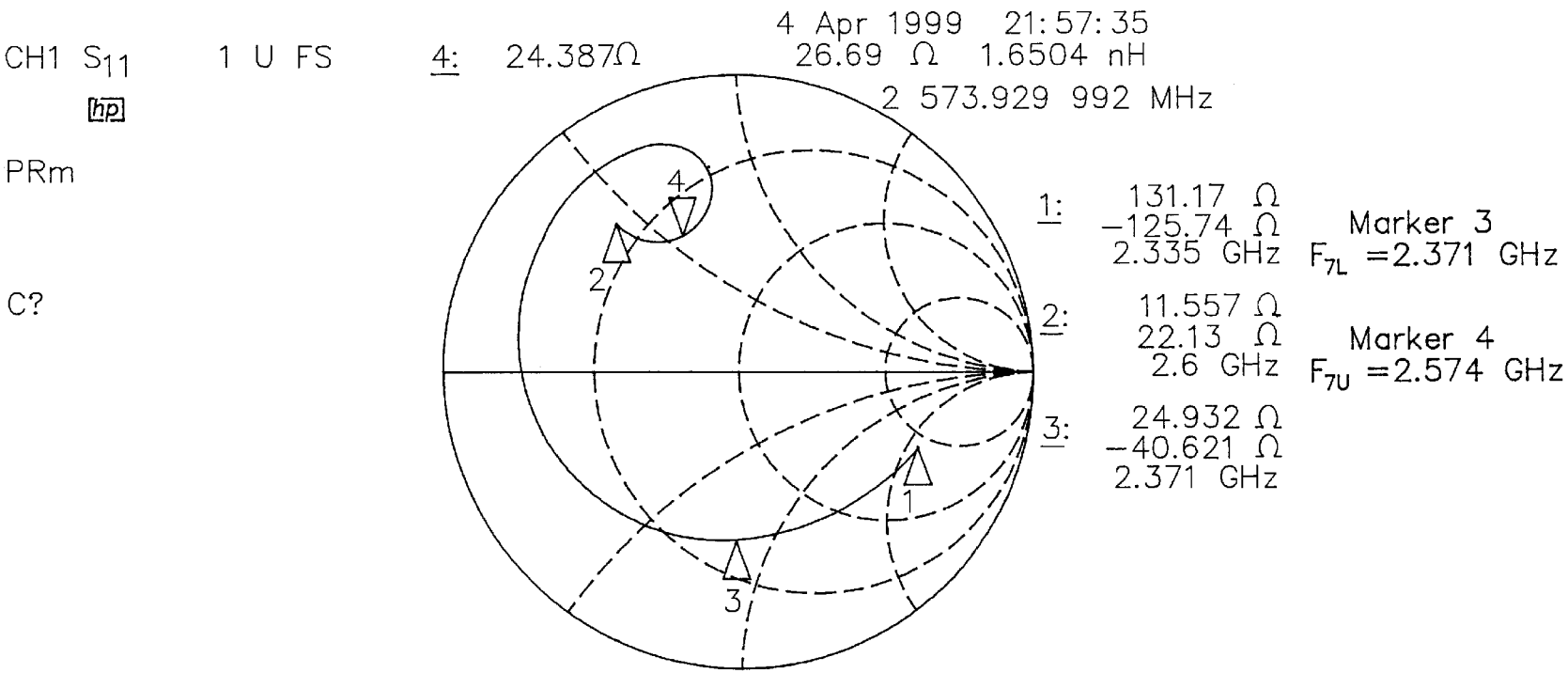
FIGS. 7A and 7B illustrate the performance characteristics of microstrip antenna of FIGS. 6A and 6B.
Figure 7B:
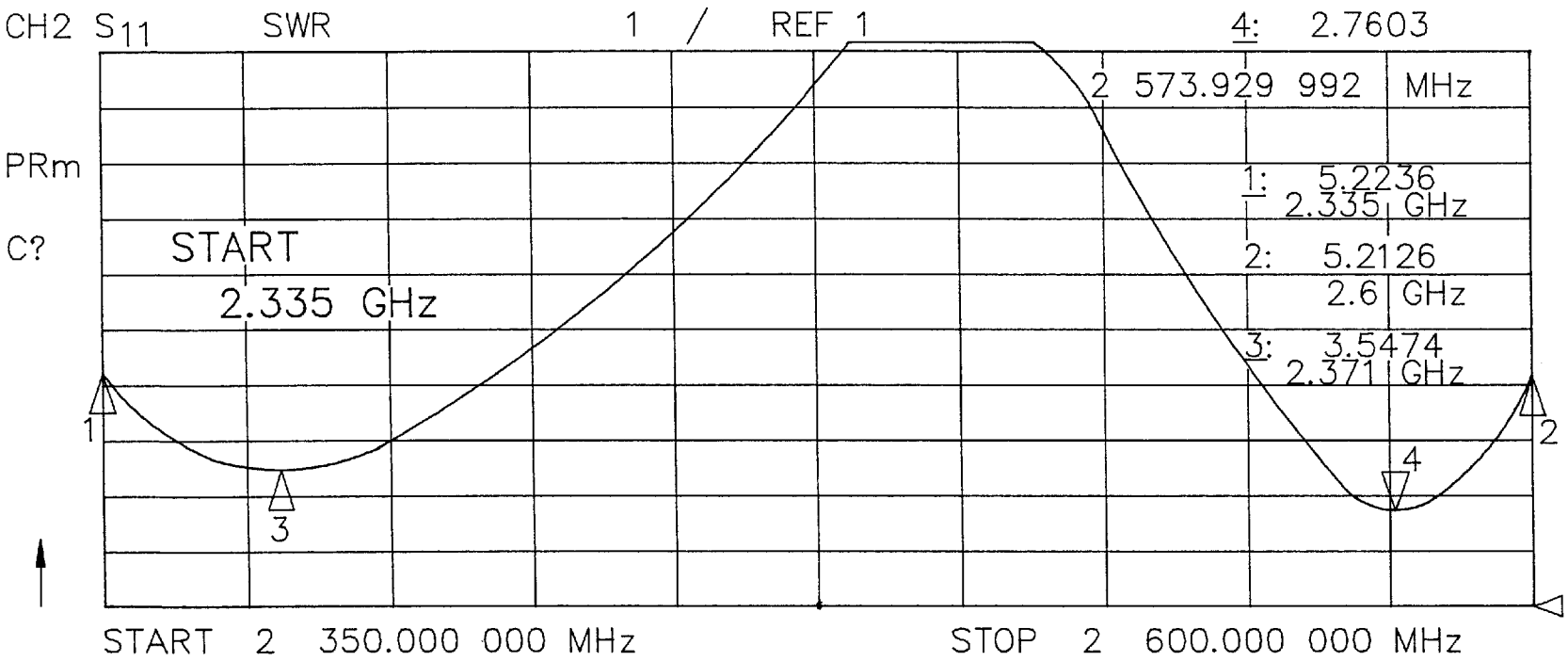

The microstrip antenna 60 illustrated in FIGS. 6A and 6B is intended to demonstrate the dual resonance of a microstrip antenna using a single slot. The microstrip antenna 60 (FIGS. 6A and 6B) differs from the microstrip antenna 40 (FIG. 4) in that antenna 60 has a slot 26 in its radiating element 12. It is noted that all other elements on microstrip antenna 60 are identical to that of microstrip antenna 40 which was previously explained. Further, repetitive description of antenna 60 is therefore not given. The test results of the microstrip antenna 60 are illustrated in FIGS. 7A and 7B. The dual resonance characteristics of the microstrip antenna 60 due to a slot 26 in its radiating element are shown in FIG. 7B. The two resonant frequencies $f_{7L}$=2.371 GHz and $f_{7U}$=2.574 GHz (FIG. 7B) are lower than the resonant frequency $f_5$ (FIG. 5B) of a microstrip antenna 40 referred to FIG. 4. The frequency ratio $f_{R7}(f_{R7}-f_{R7}=f_{7U}/f_{7L})$ is 1.086. Because of this relatively large frequency ratio, the two resonant frequencies are rather widely separated.

Figure 8A:
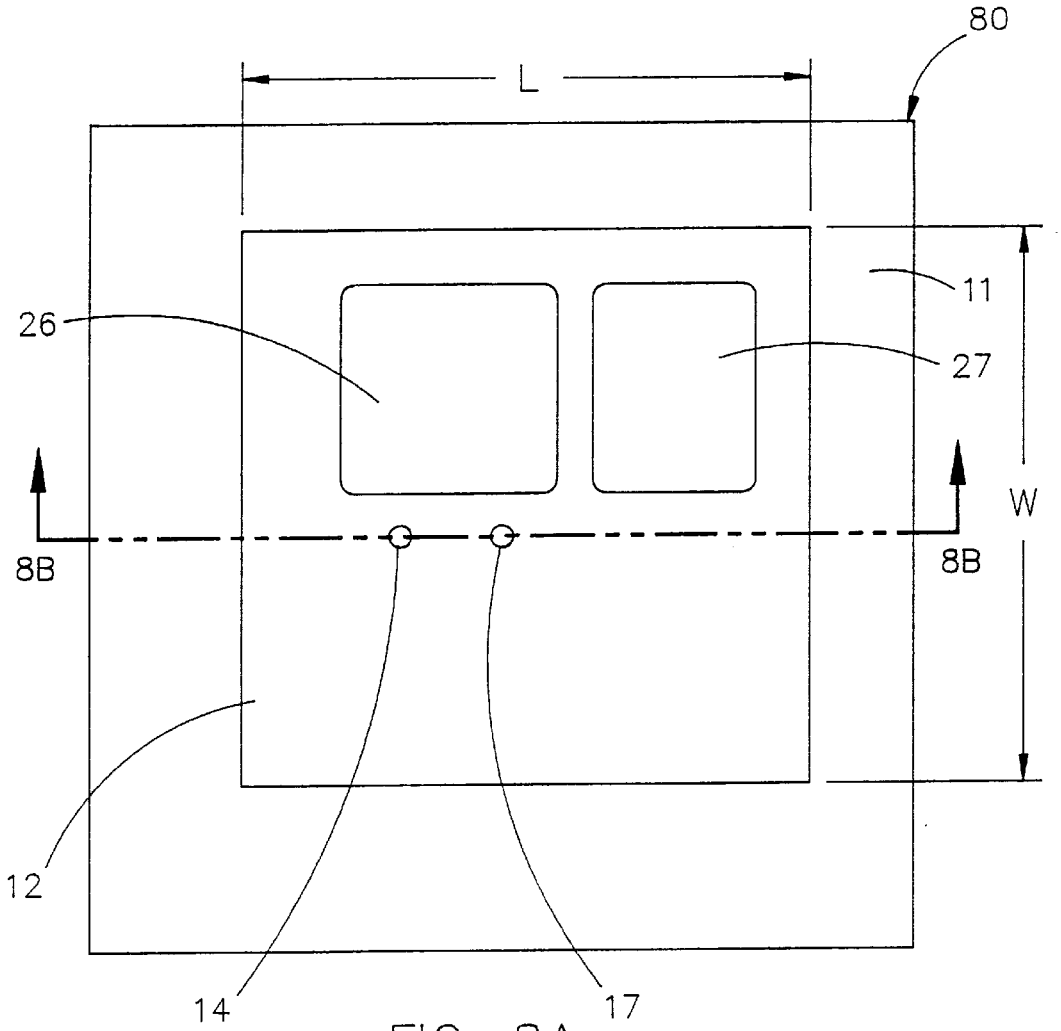
FIG. 8A illustrates the design configuration of a further embodiment of the microstrip antenna.
Figure 8B:
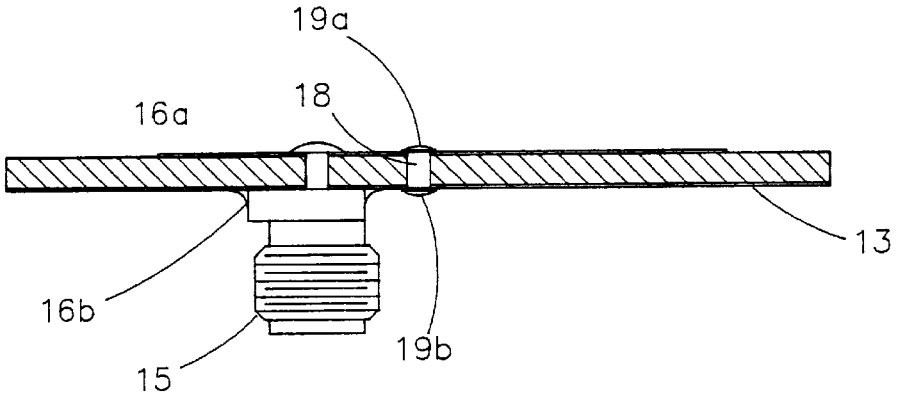
FIG. 8B is a sectional view taken along the line 8B—8B of FIG. 8A and which shows a conductive shorting post which is not shown in FIG. 8A.
Figure 9A:
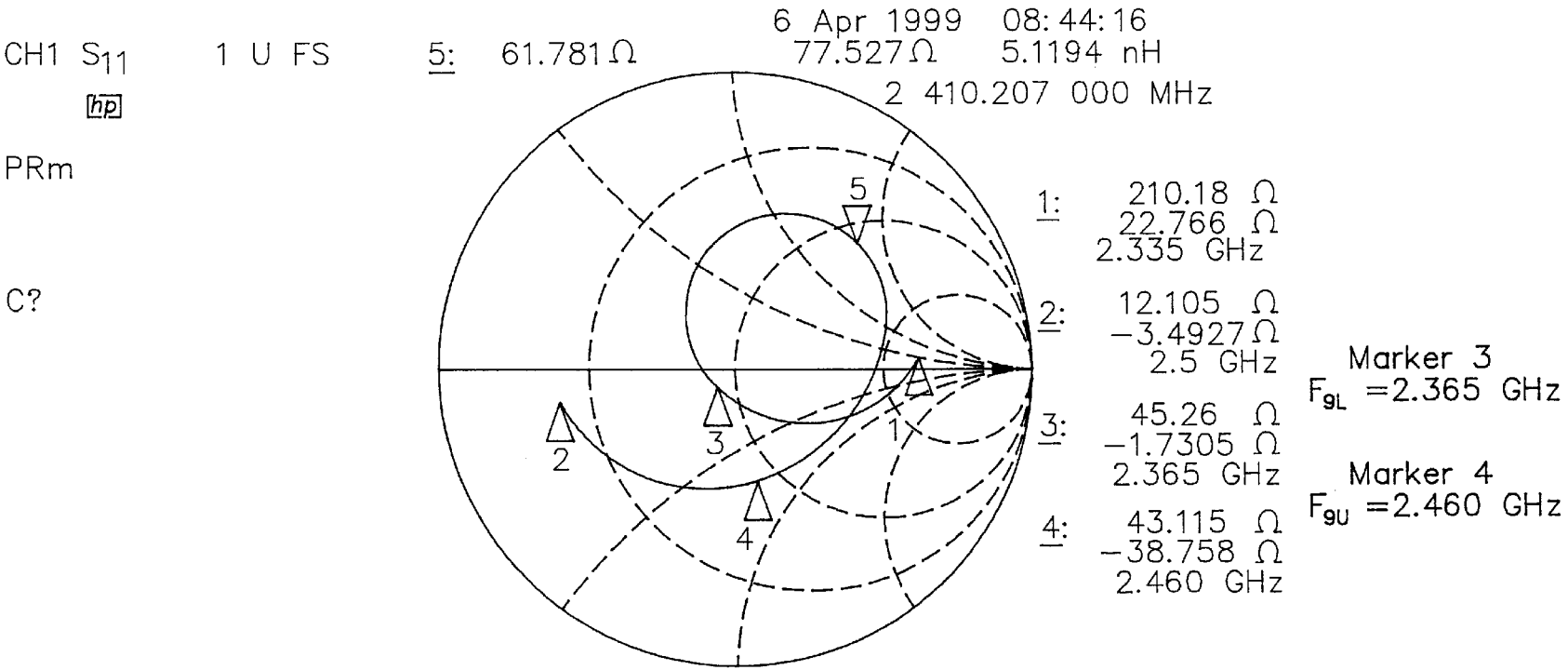
FIGS. 9A and 9B illustrate the performance characteristics of the microstrip antenna of FIGS. 8A and 8B.
Figure 9B:
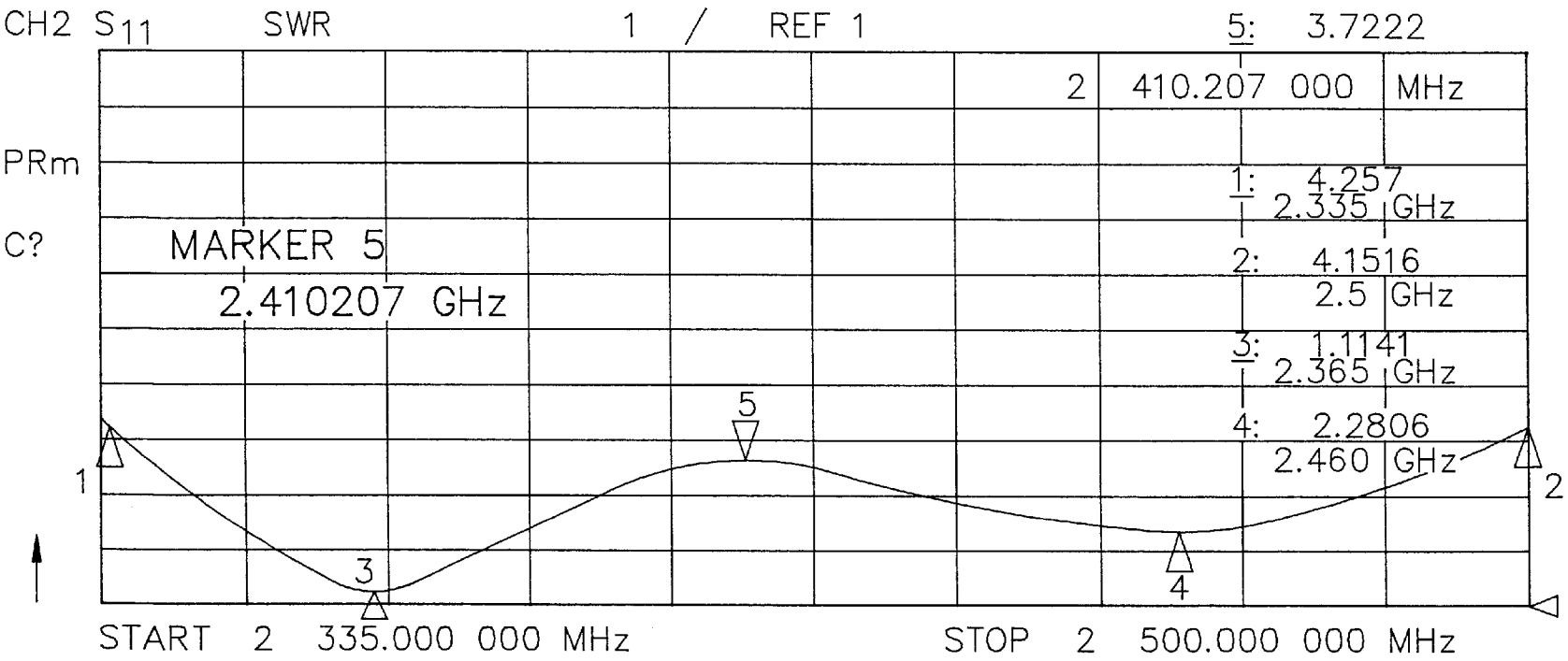

Microstrip antenna 80 shown FIG. 8 has been configured to reduce the frequency ratio $f_{R7}$ further than model 60. The microstrip antenna 80 (FIG. 8) differs from the microstrip antenna 60 (FIG. 6) in that the antenna 80 has an additional slot 27 in its radiating element 12. It is noted that all other elements on microstrip antenna 80 are identical to that of microstrip antenna 60, which has been explained earlier. Further description of antenna 80 is therefore deleted to avoid repetition. The test results of the microstrip antenna 80 are illustrated in FIGS. 9A and 9B. The changes in the dual resonance characteristics of the microstrip antenna 80 due to the slot 27 that has been added to its radiating element 12, are illustrated in FIG. 9B. The two resonant frequencies $f_{9L}$=2.365 GHz: $f_{9U}$=2.46 GHz (FIG. 9B) are lower than the corresponding resonant frequencies $f_{7L}$;$f_{7U}$ (FIG. 7B) of microstrip antenna 60 referred to FIG. 6. The frequency ratio $f_{R9}(f_{R9}=f_{9U}/f_{9L})$ is 1.04. Because of lower value of frequency ratio $f_{R9}$ (in comparison to $f_{R7}$=1.086), the separation between the two frequencies $f_{9L}$ and $f_{9U}$ is reduced. Thus the additional slot 27 in the radiating element 12 of microstrip antenna 80 has the desirable effect of positioning the two resonant bands closer.

Figure 10A:
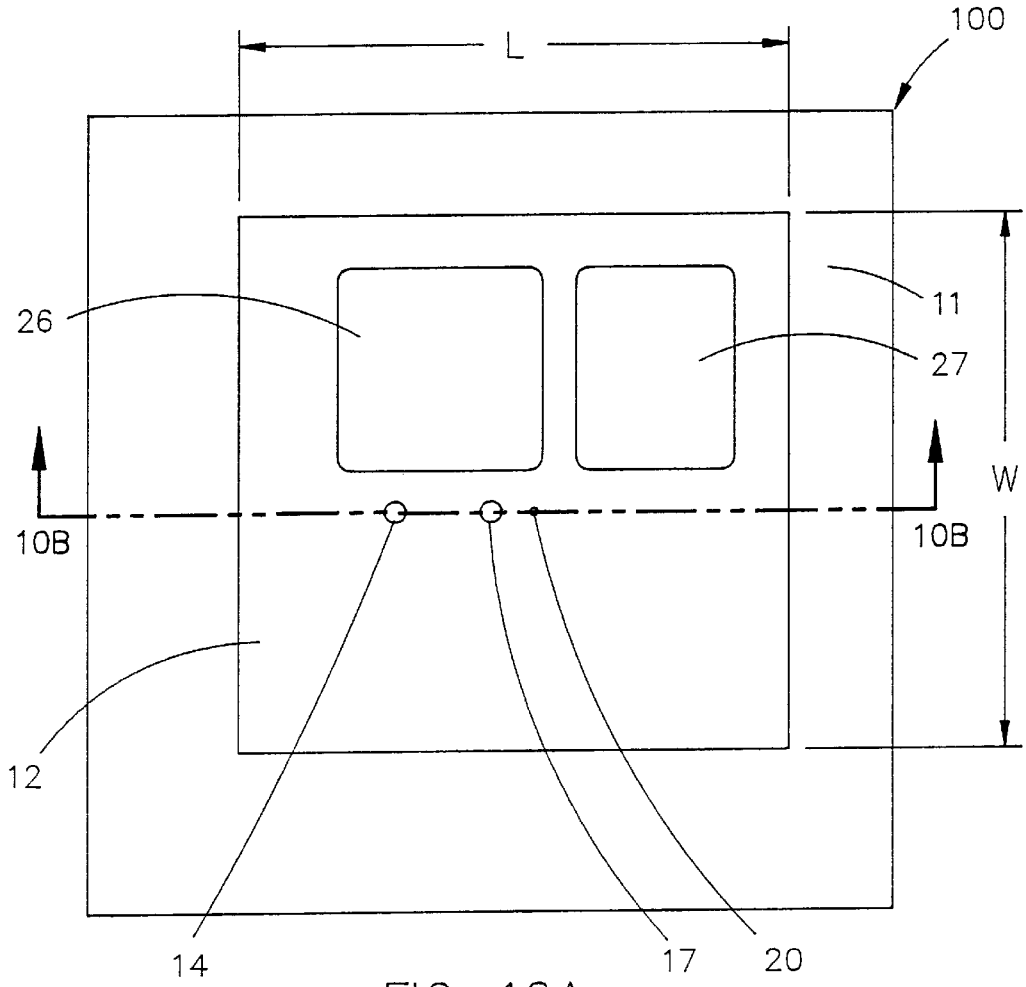
FIG. 10A illustrates the design configuration of a further embodiment of the microstrip antenna.
Figure 10B:
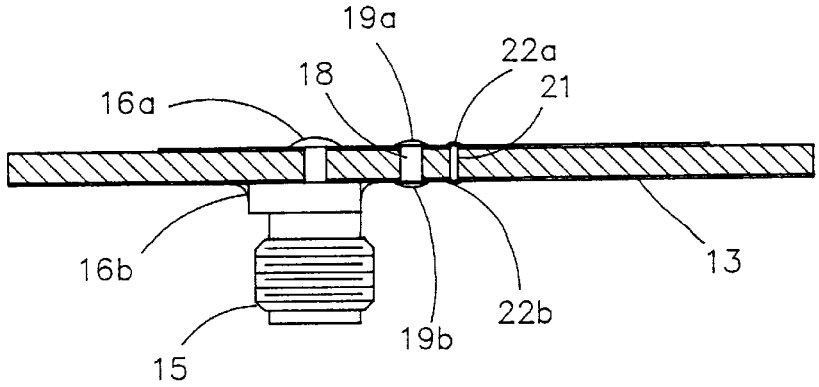
FIG. 10B is a sectional view taken along the line 10B—10B of FIG. 10A showing shorting posts which are not shown in FIG. 10A.
Figure 11A:
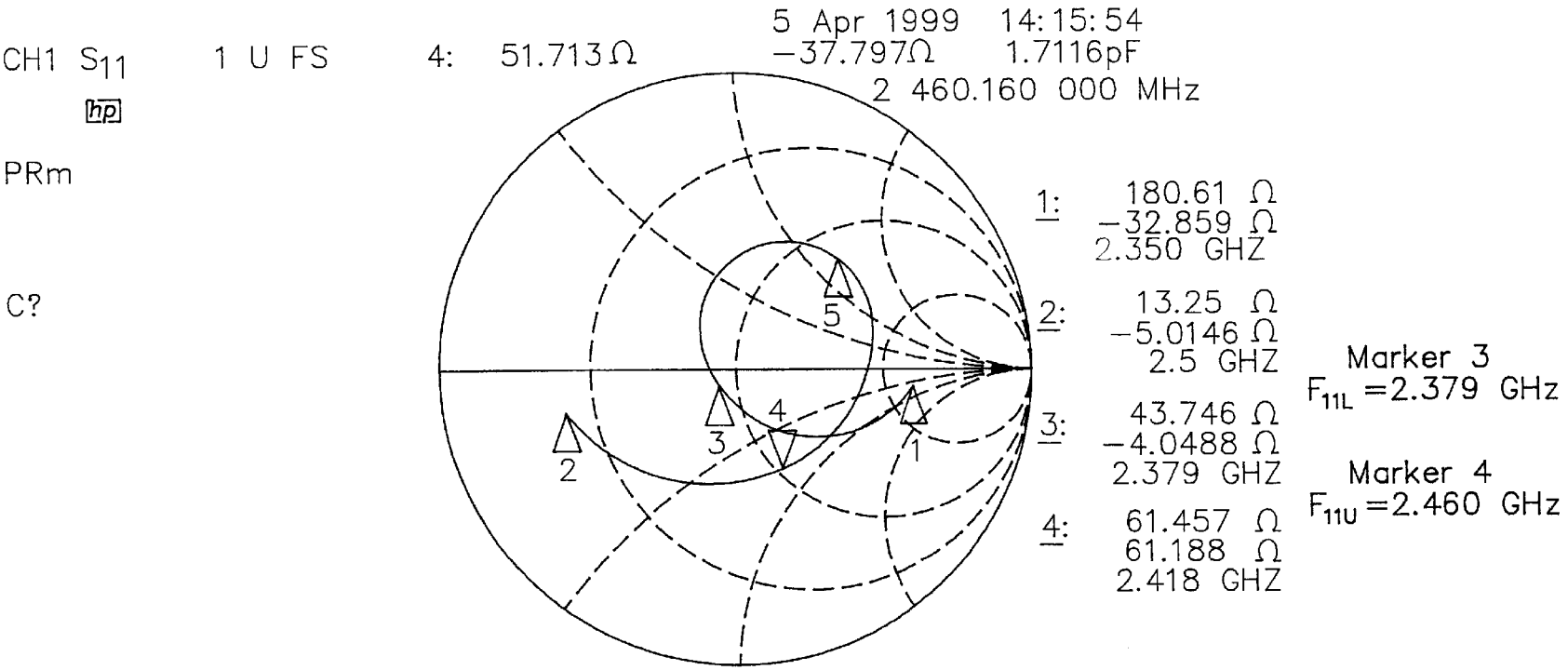
FIGS. 11A and 11B illustrate the performance characteristics of the microstrip antenna of FIGS. 10A and 10B.
Figure 11B:
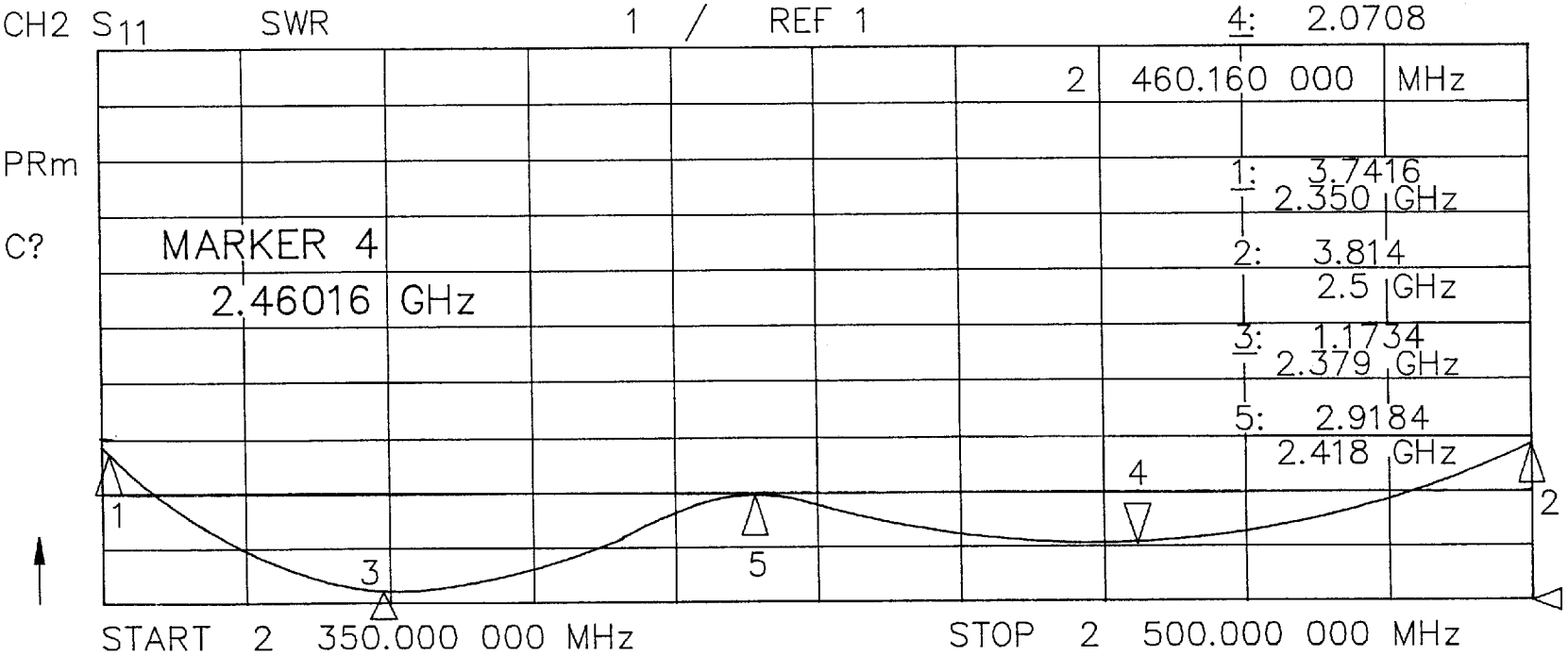
Figure 12A:
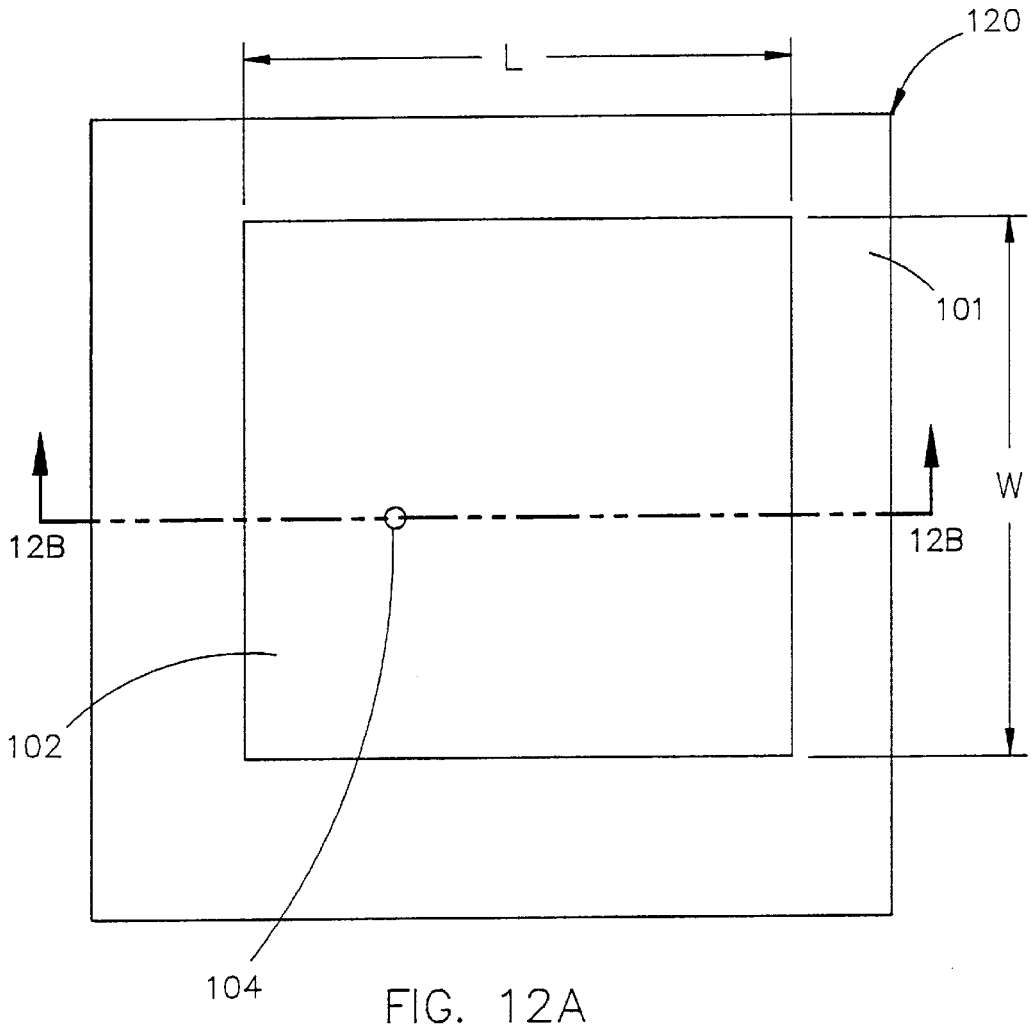
FIG. 12A (PRIOR ART)
FIGS. 12A and 12B illustrate the configuration of a prior art microstrip antenna with a thick substrate.
Figure 12B:
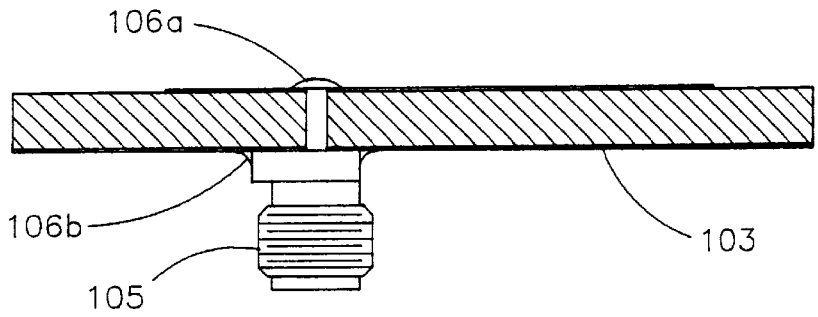
FIG. 12B (PRIOR ART)
Figure 13:
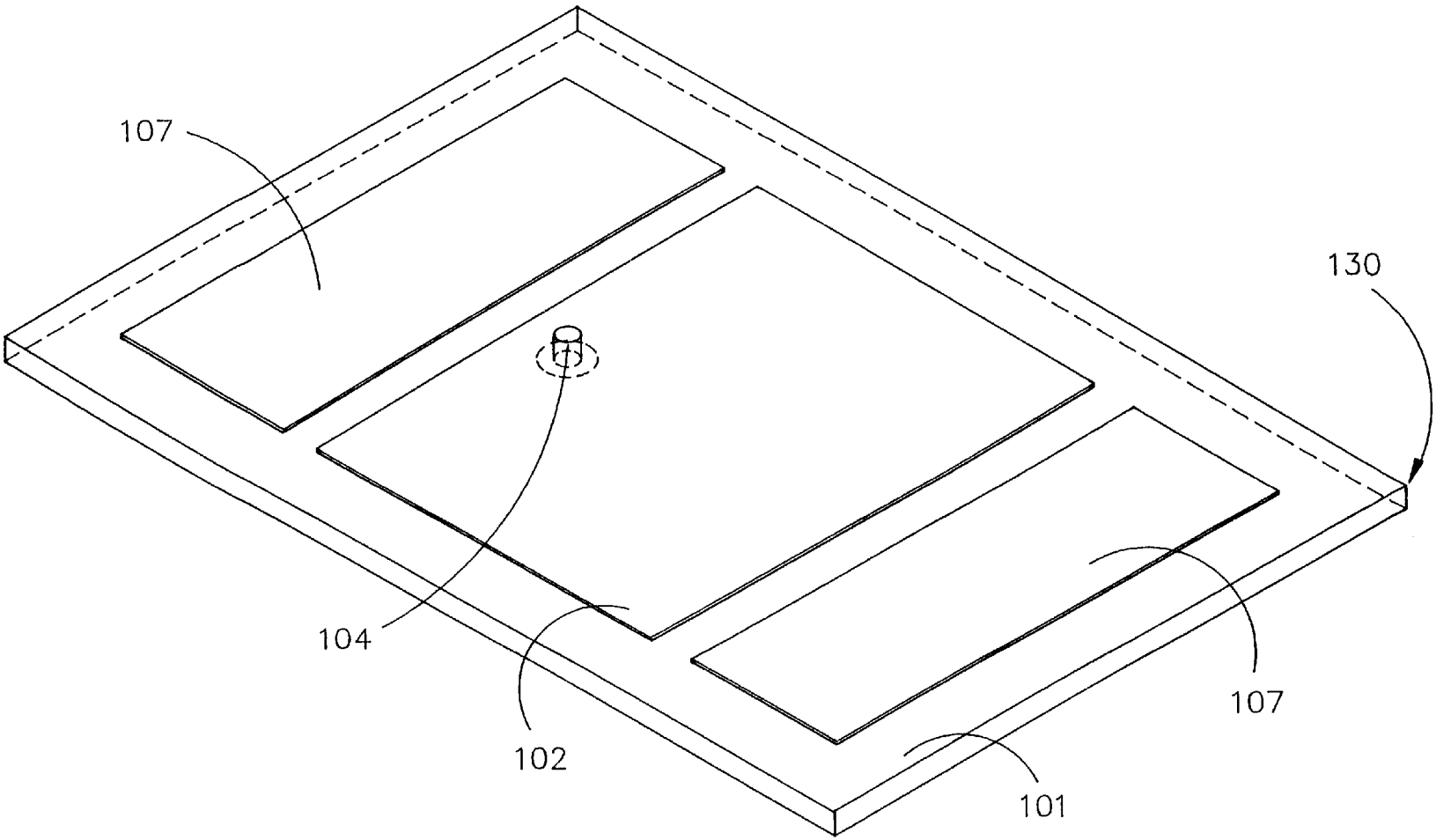
FIG. 13 (PRIOR ART)
FIG. 13 is an isometric view of a prior art microstrip antenna with parasitic elements.
Figure 14:
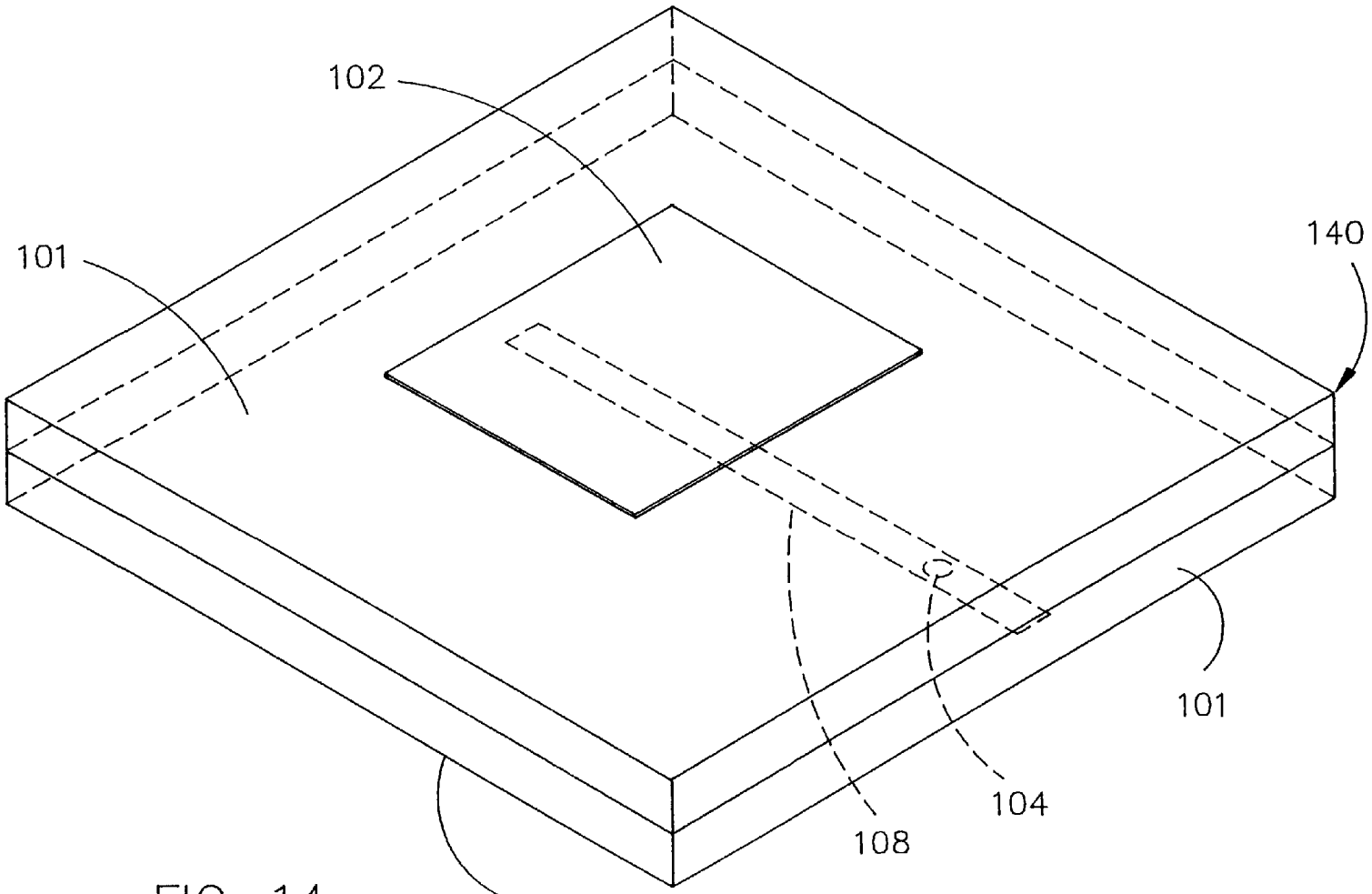
FIG. 14 (PRIOR ART)
FIG. 14 is an isometric view of a prior art electromagnetically coupled microstrip antenna.
Figure 15:
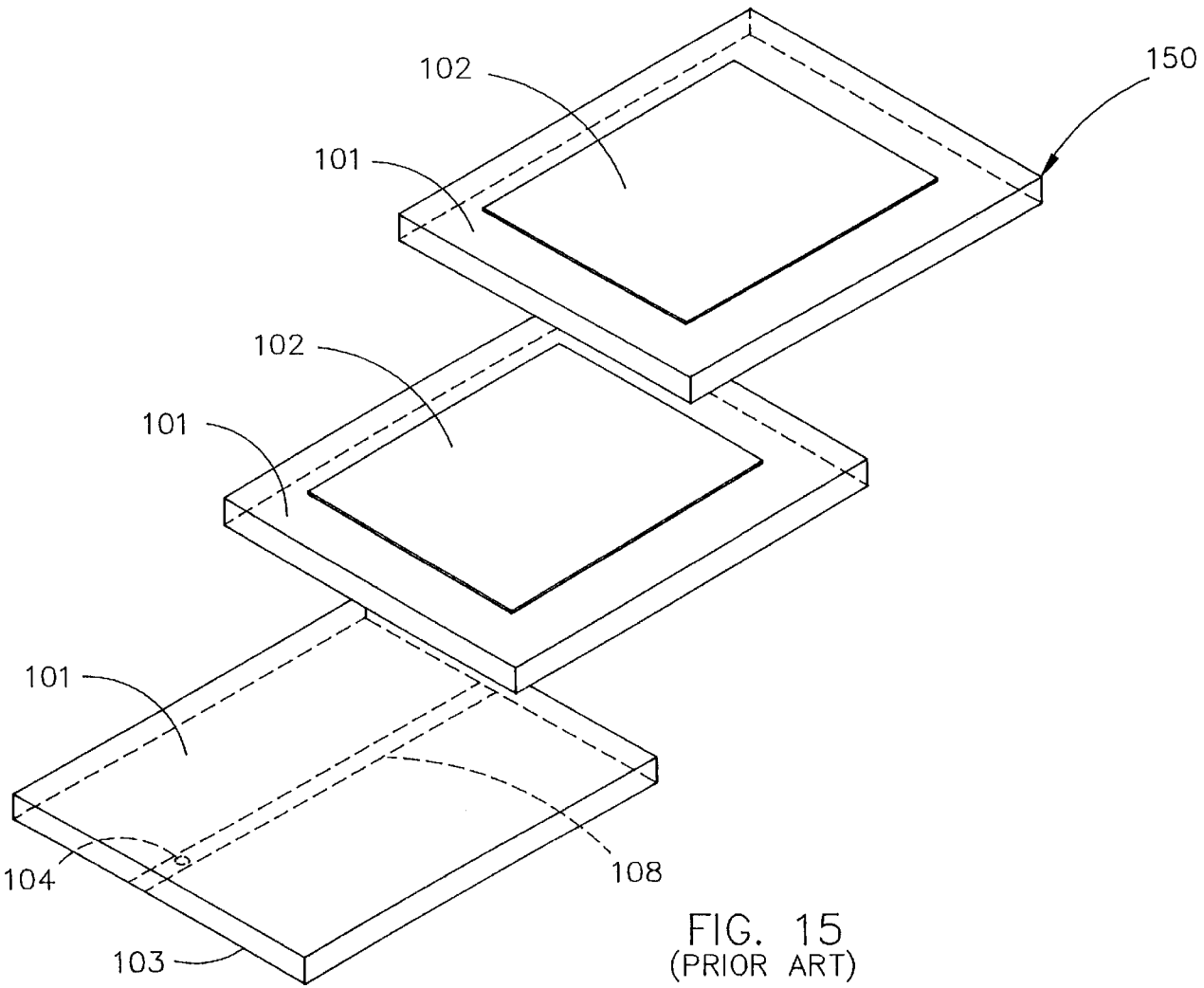
FIG. 15 (PRIOR ART)
FIG. 15 is an isometric view of a prior art microstrip antenna with stacked radiating elements.
Figure 16:
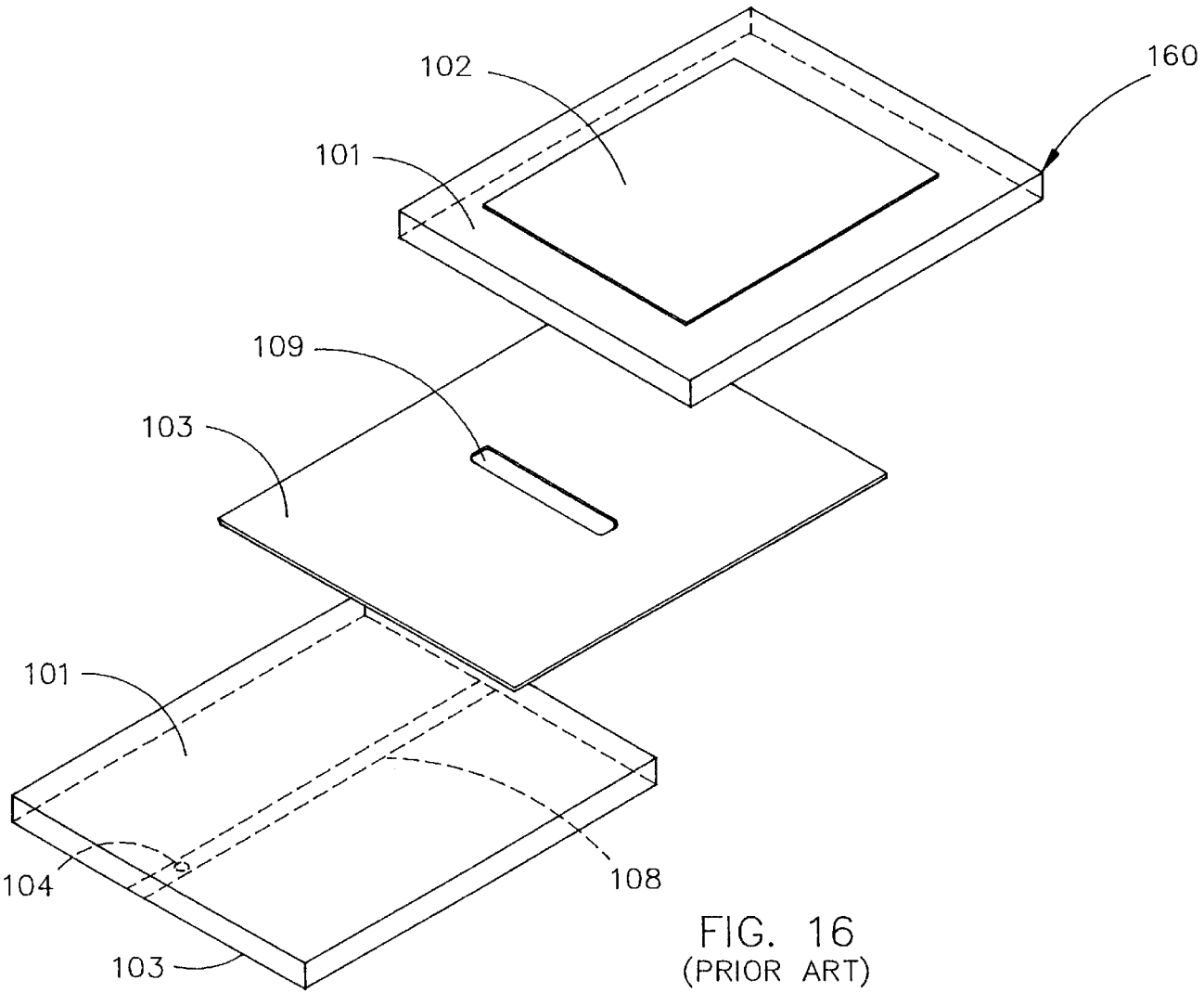
FIG. 16 (PRIOR ART)
FIG. 16 is an isometric view of a prior art aperture coupled microstrip antenna.
Figure 17A:
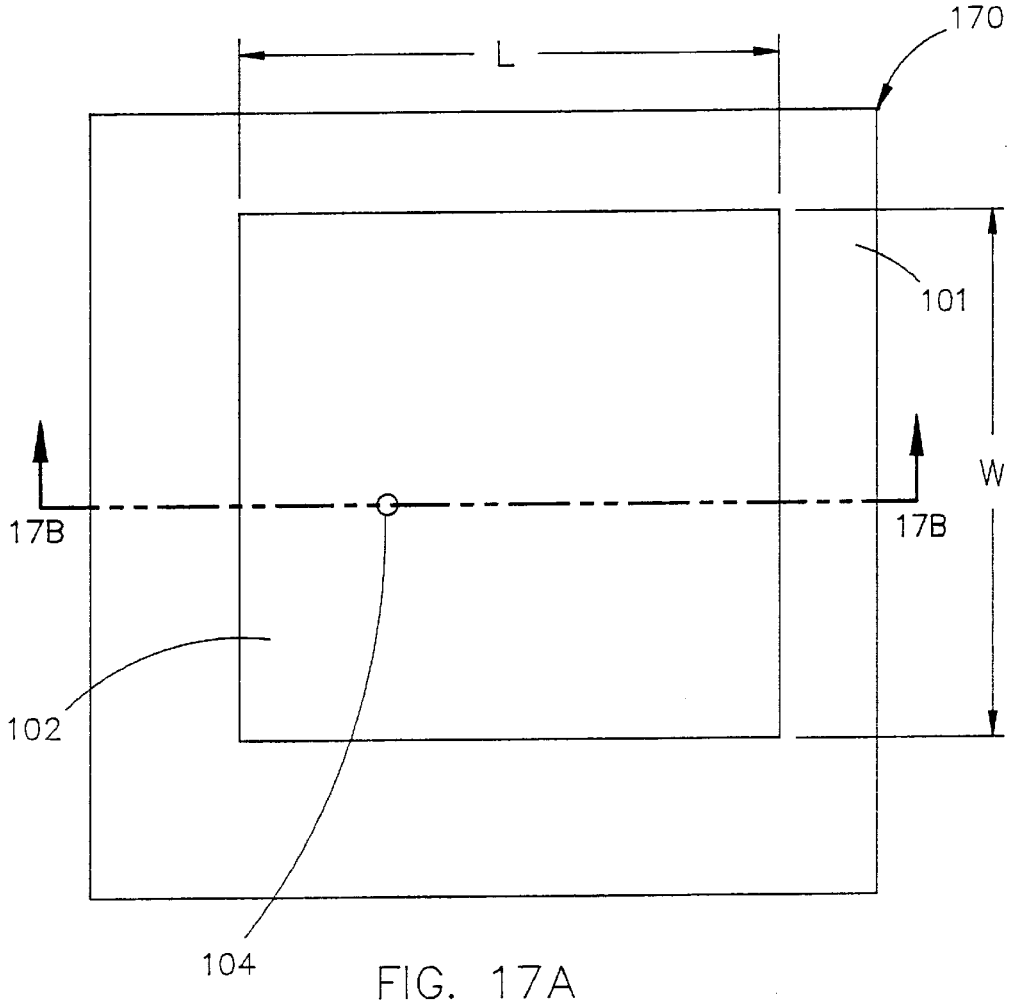
FIG. 17A (PRIOR ART)
FIG. 17A is a plan view of a prior art microstrip antenna.
Figure 17B:
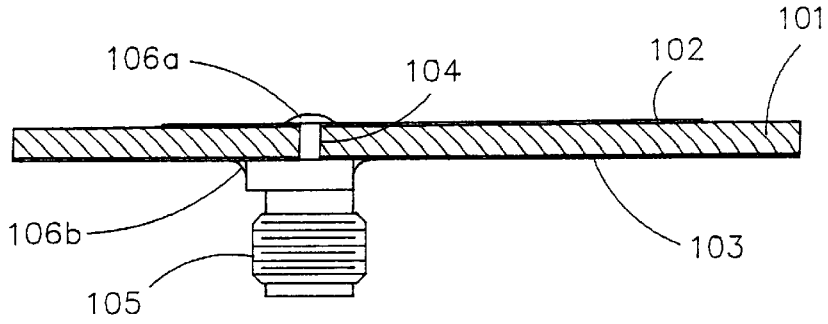
FIG. 17B (PRIOR ART)
FIG. 17B is a sectional view taken along the line 17B—17B of FIG. 17A.

The microstrip antenna 100 referred to FIG. 10 is designed to reduce the frequency ratio $f_{R9}$ further. The microstrip antenna 100 (FIG. 10) differs from the microstrip antenna 80 (FIG. 8) in that the antenna 100 has an additional conductive shorting post 21 on its radiating element 12. It is noted that all other elements on microstrip antenna 100 are the same as that of microstrip antenna 80, which has already been described. Further explanation of antenna 100 therefore has not been given. The test results of the microstrip antenna 100 are in FIGS. 11A and 11B. The changes in dual resonance characteristics of the microstrip antenna 100 due to conductive shorting post or pin 21 on its radiating element 12 are shown in FIG. 11B. The two resonant frequencies are $f_{11L}$=2.379 GHz:$f_{11U}$=2.46 GHz (FIG. 11B). The frequency ratio $f_{R11}(f_{R11}=f_{11U}/f_{11L})$ is 1.034. Because of lower value of frequency ratio $f_{R11}$ (in comparison to $f_{R9}$=1.04), the separation between the two frequencies $f_{11L}$ and $f_{11U}$ is further reduced. Thus the conductive shorting post 21 on the radiating element 12 of microstrip antenna 100 has the desirable effect of positioning the two resonant bands much closer.

The microstrip antenna 10 shown in FIGS. 1 and 2 is designed to reduce the frequency ratio $f_{R11}$, greater than the frequency ratio reduction of antenna 100. The microstrip antenna 10 (FIGS. 1 and 2) differs from the microstrip antenna 100 (FIG. 10) in that the antenna 10 has an additional conductive shorting post 24 between its radiating element 12 and its ground plane 13. It is noted that all other elements on microstrip antenna 10 are identical to that of microstrip antenna 100 which has previously been described. The configuration of microstrip antenna 10, which is the preferred embodiment of this invention, has already been explained in detail. To bring out the importance of the additional conductive shorting post 24 on the radiating element 12 of the microstrip antenna 10 (FIGS. 1 and 2), the test results of antenna 10 will be analyzed again. The changes in dual resonance characteristics of the microstrip antenna 10 due to conductive shorting post 24 on its radiating element 12 are shown in FIGS. 3A and 3B. The two resonant frequencies are at $f_{3L}$=2.419 GHz: $f_{3U}$=2.475 GHZ (FIG. 3B). The ratio $f_{R3}$ ($f_{R3}=f_{3U}/f_{3L}$) is 1.023 as compared to ratio $f_{R11}(f_{R11}=f_{11U}/f_{11L})$ 1.034 of microstrip antenna 100 referred in FIG. 10. To the best of knowledge of the applicants, this is the lowest frequency ratio that has been attained and reported in the open literature. Because of the very low frequency ratio value $f_{R3}$, the separation between the two resonant frequencies $f_{3L}$ and $f_{3U}$ has been greatly reduced. Thus the conductive shorting post 24 on the radiating element 12 of microstrip antenna 10 serves in the role of positioning the two resonant bands much closer and in fact they are in the ISM band 2.4–2.5 GHz.

As can be seen from the foregoing discussions, a novel microstrip antenna with a wider bandwidth has been demonstrated. The microstrip antenna 10 of this invention has a wider bandwidth than a conventional microstrip antenna of identical dimensions. The use of slots and conductive shorting posts offer reactive load to the radiating element of the microstrip antenna 10 thereby causing a reduction of the resonant frequency. The reduction of the resonant frequency of microstrip antenna 10 has been accomplished without increasing the antenna's effective area, thereby achieving the miniaturization of the size. The increase in the bandwidth of the microstrip antenna 10 of this invention has been achieved using only a single substrate thereby accomplishing additional miniaturization in size because of reduced height. Microstrip antenna 10 of this invention is lightweight, compact, cost-effective, and easy to manufacture due to its structural simplicity.

Thus the microstrip antenna of this invention has accomplished at least all of its stated objectives.

We claim:

1. A microstrip antenna, comprising:

a substrate;

a radiating element constructed on the top surface of said substrate;

said radiating element consisting of two reactive loading slots positioned adjacent to each other and on the same half of said radiating element with respect to the center line of the antenna;

a ground plane on the bottom surface of said substrate;

a through hole at a position corresponding to said radiating element of said substrate;

and a power feeding conductor at a position corresponding to said radiating element on said substrate.

2. A microstrip antenna, comprising:

a substrate;

a radiating element constructed on the top surface of said substrate; wherein said radiating element consists of two reactive loading slots positioned adjacent to each other and on the same half of said radiating element with respect to the center line of the antenna;

a ground plane on the bottom surface of said substrate;

a plurality of through holes at positions corresponding to said radiating element of said substrate;

a power feeding conductor at a position corresponding to said radiating element on said substrate;

and a plurality of conductive shorting posts at positions corresponding to said radiating element of said substrate.

* * * * *